US005727626A

United States Patent [19]

Kato

[11] Patent Number: 5,727,626

[45] Date of Patent: Mar. 17, 1998

[54] HEADER TANK OF HEAT EXCHANGER

[75] Inventor: Soichi Kato, Konan-machi, Japan

[73] Assignee: Zexel Corporation, Tokyo, Japan

[21] Appl. No.: 594,325

[22] Filed: Jan. 30, 1996

Related U.S. Application Data

[63] Continuation of Ser. No. 276,658, Jul. 19, 1994, abandoned.

[30] Foreign Application Priority Data

Jul. 20, 1993 [JP] Japan ..... 5-179077

[51] Int. Cl.[6] ..... F28F 9/02

[52] U.S. Cl. ..... 165/173; 165/153

[58] Field of Search ..... 165/153, 173, 165/174, 175

[56] References Cited

U.S. PATENT DOCUMENTS

| | | | |
|---|---|---|---|
| 4,917,180 | 4/1990 | Wolf et al. | 165/175 X |
| 5,107,926 | 4/1992 | Calleson | 165/153 X |
| 5,207,738 | 5/1993 | Dey | 165/173 X |
| 5,226,490 | 7/1993 | Ryan et al. | 165/173 |
| 5,236,044 | 8/1993 | Nagasaka et al. | 165/173 X |
| 5,329,995 | 7/1994 | Dey et al. | 165/173 X |
| 5,341,872 | 8/1994 | Mercurio | 165/173 |

FOREIGN PATENT DOCUMENTS 387080 9/1991 Japan .

*Primary Examiner*—John Fox
*Attorney, Agent, or Firm*—Kanesaka & Takeuchi

[57] ABSTRACT

A header tank for a heat exchanger in the parallel flow type includes a plurality of tubes (2) and corrugated fins (3) stacked alternately, both ends of the stacked tubes are connected with the header tanks (4). Each header tank includes partition plates (12) therein. The header tank is formed by radially divided tow parts consisting of an end plate (7) and a tank plate (8). Pressing members (19) are provided on either the end plate or the tank plate for pressing one of the plate against the other plate for engagement therewith. The header tank is characterized in that end partition plates (13) are provided to the ends of the header tank, and the pressing members on one of the plates are located near the positions where the end partition plates are provided.

4 Claims, 7 Drawing Sheets

HEADER TANK OF HEAT EXCHANGER

This application is a continuation of Ser. No. 08/276,658, filed Jul. 19, 1994, now abandoned.

FIELD OF THE INVENTION

This invention relates to a header tank of heat exchanger formed by two radially divided parts consisting of an end plate and a tank plate, particularly to a structure of closing the ends of the header tank.

PRIOR ART

Heat exchangers of the parallel flow type conventionally comprise a plurality of tubes and corrugated fins stacked alternately, and both ends of the stacked tubes are inserted into insertion openings provided in the header tanks to be joined therewith. The header tank formed by two divided parts consisting of the end plate and the tank plate, which are assembled in radial direction, is known (for example, as shown in Japanese Utility Model Laid-Open publication No. Hei 3(1991)-87080).

The upper and lower end openings of each header tank are closed with blank caps formed by press working, and, inside the header tank, there are provided partition plates as necessary to longitudinally partition the header tank. Each partition plate is placed between the end plate and the tank plate and positioned by caulking claws (pressing members) provided at the joining portion of the tank plate towards the end plate, thereupon the partition plate is blazed together with the header tank for integral connection therewith.

With the parallel flow type heat exchanger of such structure, a heat exchange medium flows through a plurality of zig zag passages between an inlet joint and an outlet joint provided on the header tanks.

However, with such conventional header tank of heat exchanger, namely, the header tank consisting of two parts, the upper and lower end openings of the header tank are closed with blank caps. This structure inevitably presents problems of increasing the number of parts and requiring additional processing steps, which, in turn, result in high cost. Because of this, a possibility of using the partition plates for closing the upper and lower end openings of the header tank has been studied in an effort to use common parts to reduce the number of parts.

However, this proposed method is disadvantageous in that when the partition plates are assembled with the end openings of the header tank and secured by blazing in a furnace, a gap is formed between the partition plate and the header thank by deformation of the header tank during heating, so that reliable blazing of the partition plate with the header tank cannot be accomplished.

In view of such problem, the object of the present invention is to provide a header thank of heat exchanger which eliminates the use of blank caps, but, instead, end partition plates, which are in the same or closely similar configuration to the partition plates used inside the header tank, are used for closing the end openings of the header tank, thereby to establish reliable blazing of the partition plates with the header tank. This is particularly advantageous because the end partition plates in the same configuration as that of the partition plates are used, which allows the use of common parts, and hence results in reduction of the number of parts.

SUMMARY OF THE INVENTION

The header tank of heat exchanger according to this invention is, in a parallel flow type heat exchanger comprising a plurality of tubes and corrugated fins stacked alternately, wherein both ends of the stacked tubes are connected with the header tanks in communication therewith, each header tank includes partition plates therein, and the header tank is formed by two radially divided parts consisting of an end plate and a tank plate, pressing members are provided on one of the end plate and the tank plate for pressing one of the plates against the other plate for engagement therewith, characterized in that end partition plates are provided at the ends of the header tank, and the pressing members on one of the plates are located near the positions where the end partition plates are provided.

With the present invention, assembly of the header tank is carried out by first setting the partition plates and the end partition plates at the respective positions in the tank plate and the end plate, engaging the tank plate with the end plate by pressing the tank plate against the end plate, and bending the pressing members to complete the assembly of the header tank with the partition plates and the end partition plates mounted thereon. Thereafter, the ends of the stacked flat tubes are inserted into insertion openings of each header tank to assemble the heat exchanger, whereupon the assembled heat exchanger is brazed in a furnace for integral connection.

During blazing, radial opening of the tank plate and the end plate caused by deformation of the header tank under heating is prevented, because the end partition plates at the ends of the header tank are externally pressed by the pressing members at the locations where the partition plates are provided or within a range of tube pitch from the end partition plate, so that formation of a gap between the end plate and the tank plate of the header tank is eliminated, which makes it possible to accomplish reliable assembly and brazing of the heat exchanger.

Particularly advantageous is the use of the end partition plate in the same configuration with that of the partition plate so as to establish reliable closing of the end openings of the header tank, thereby the use of conventional blank caps is no longer required. As a result, the length of header tank is made shorter, and, particularly, quantities of heat exchange medium and lubricating oil collected in the lower end portion of the header tank are reduced, which, in turn, allows to reduce quantities of heat exchange medium and lubricating oil for use. Further, the use of conventional blank caps is eliminated by the use of common parts so as to reduce the number of parts. This allows reduction of the number of processing steps and associated controlling works, which, in turn, lowers the manufacturing cost. Moreover, reliable brazing is made possible, and, consequently, to yield is increased with the improved and reliable blazing.

DETAILED DESCRIPTION OF THE PREFERRED EMBODIMENTS

Figure 1:
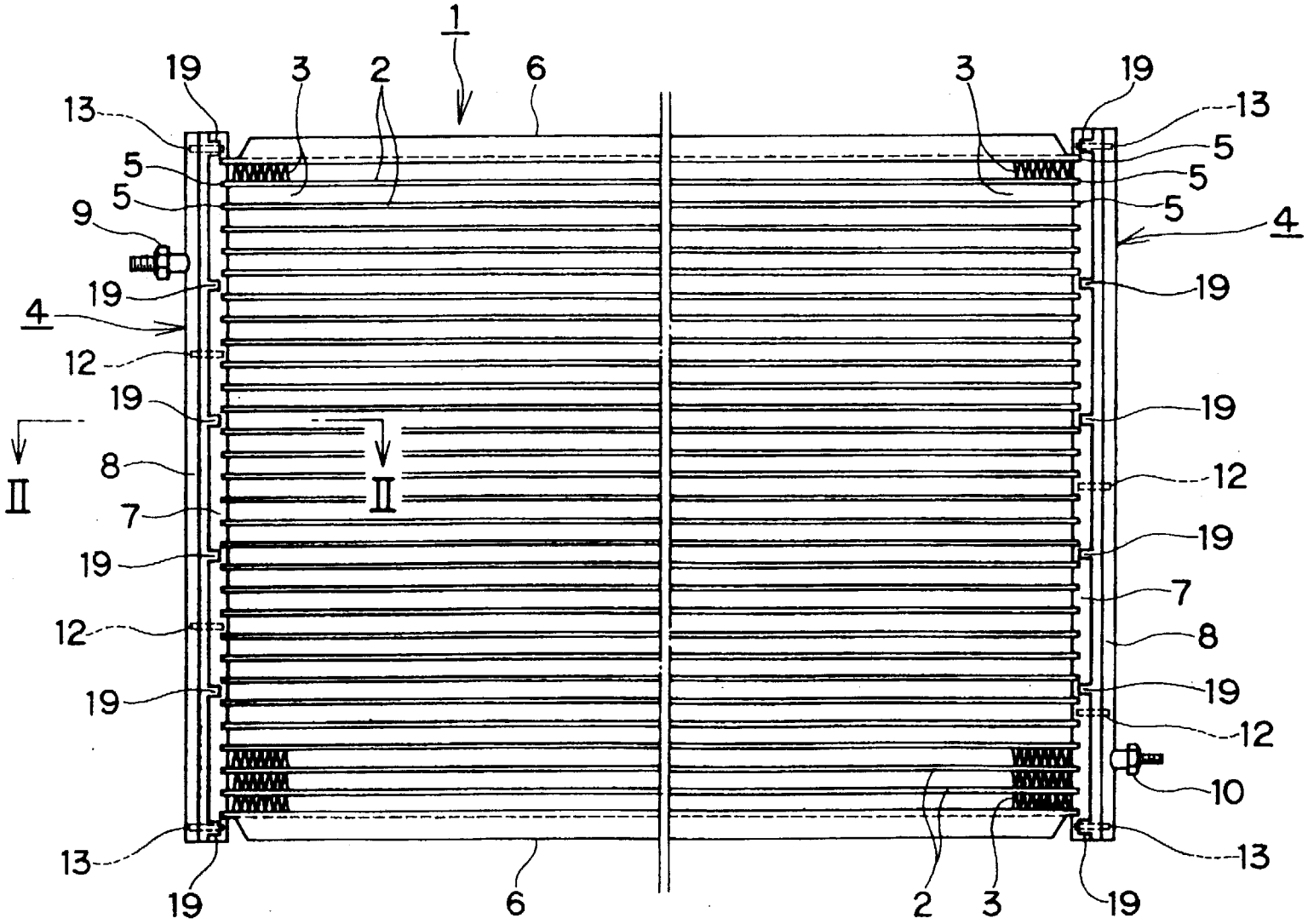
FIG. 1 is a front view of a condenser of a first embodiment of the invention.

A first embodiment of the invention will be described by referring to the accompanying drawings.

A heat exchanger 1 of this embodiment is a condenser made of aluminum or aluminum alloy which is mainly used for the car air-conditioner, comprising a plurality of flat tubes 2 and corrugated fins 3 stacked alternately, and both ends of the stacked flat tubes 2 are respectively inserted into insertion openings 5 of a header tank 4 for connection therewith. Numeral 6 designates a side plate having a U-shaped cross-section, each provided at the upper end and the lower end of the stacked flat tubes 2. Each end of the side plate 6 is inserted into an exclusive insertion opening 5 provided in the header tank 4, and, after insertion, each forward end of the side plate is bent longitudinally of the header tank 4.

Figure 2:
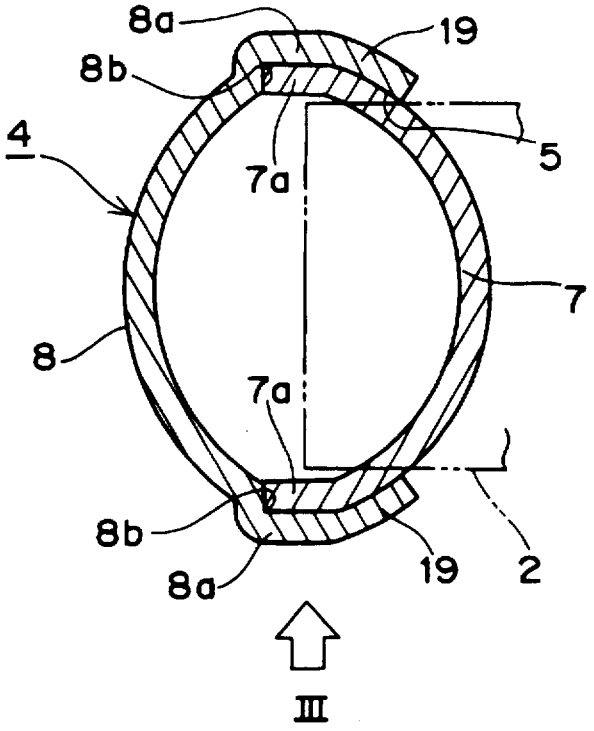
FIG. 2 is a fragmental sectional view of the header tank taken along the line II—II in FIG. 1.
Figure 3:
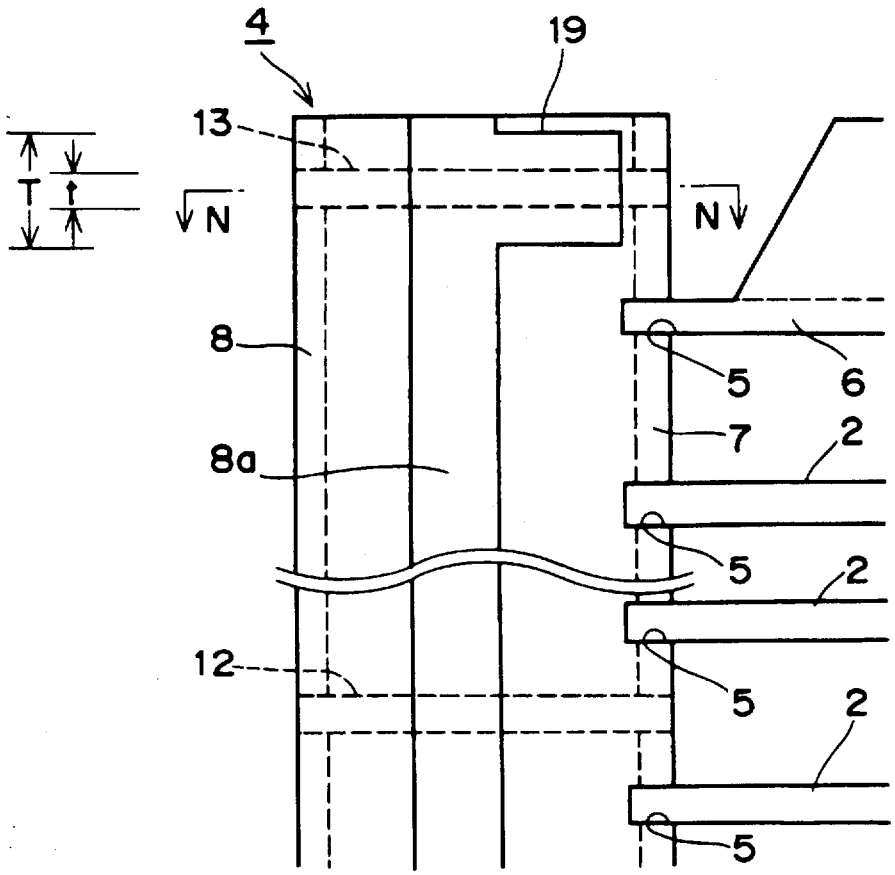
FIG. 3 is a fragmental sectional view of the header tank taken in the direction of an arrow mark III in FIG. 2.

As shown in FIGS. 2 and 3, the header tank 4 is formed by two radially engaged parts consisting of an end plate 7 and a tank plate 8. To facilitate engagement of these plates together for forming the header tank, the end plate 7 has an engagement portion 7*a* and the tank plate 8 has an engagement portion 8*a* with a step 8*b*.

Further, as shown in FIG. 1, an inlet joint 9 is connected to one of the header tanks 4 and an outlet joint 10 is connected to the other header tank 4. Inside the both header tanks 4 there are provided partition plates 12 as necessary to partition the header tank longitudinally. Each end of each header thank is closed, at a location outside of the side plate 6, by an end partition plate 13 which is the same configuration as the partition plate 12. In this parallel flow type heat exchanger 1, a heat exchange medium flows through a plurality of zig zag passages between the inlet joint 9 and the outlet joint 10.

Figure 4:
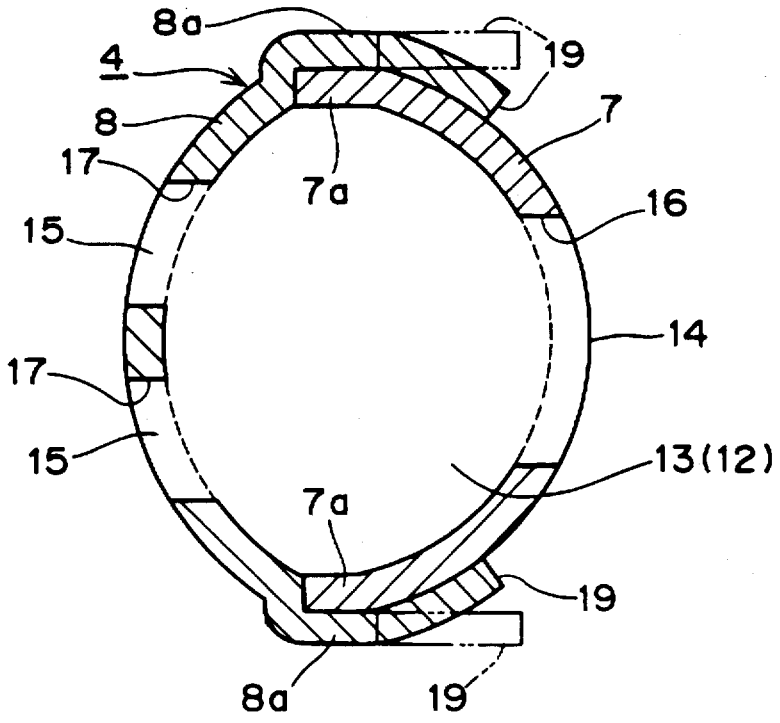
FIG. 4 is a fragmental sectional view taken along the line IV—IV in FIG. 3 for illustrating the end partition plate and the partition plate being mounted.
Figure 5:
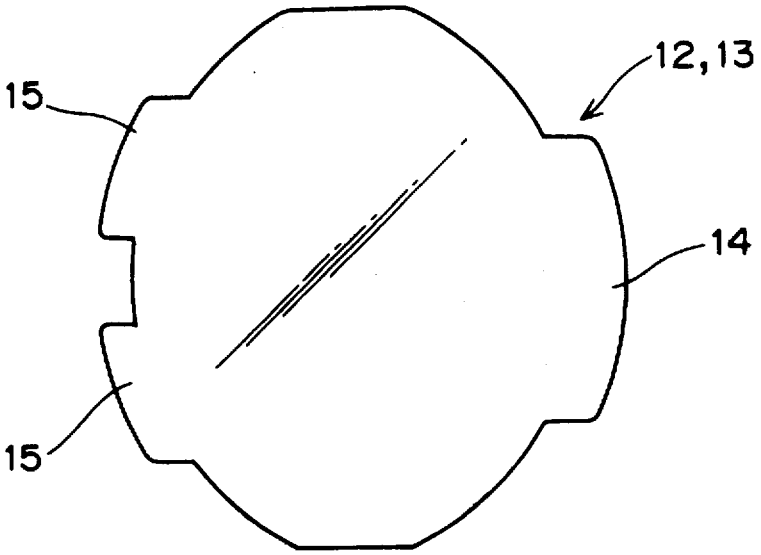
FIG. 5 is a plan view of the end partition plate and the partition plate.
Figure 6:
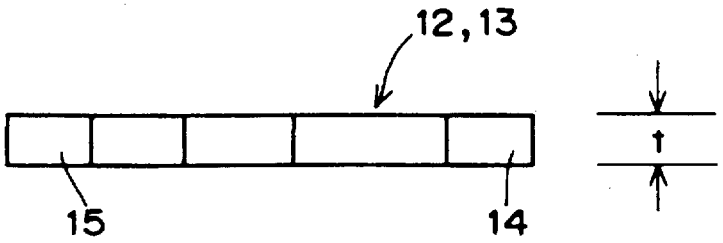
FIG. 6 is a side view of the end partition plate and the partition plate.

In more detail, the partition plate 12 and the end partition plate 13 are, as, for example, shown in FIGS. 4–6, made of a plate of 1.5 mm thickness t formed in the shape corresponding to a volume cross section of the header tank and having insertion portions 14, 15 extended into three directions on the same plane and which are formed integrally with the plate. Extended directions of these insertion portions are not limited to three directions. These insertion portions are dimensioned to a predetermined width and an extended length which is substantially equal to a wall thickness of the header tank.

The insertion portions 14, 15 of the partition plate 12 and the end partition plate 13 are so arranged that, in mounting the partition plate 12 and the end partition plate 13 on the header tank 4, the insertion portion 14 can be located at the side of the end plate 7 and the other insertion portion 15 can be located at the side of the tank plate 8. To receive these insertion portions 14, 15, the corresponding insertion grooves 16, 17 are provided at predetermined positions in the end plate 7 and the tank plate 8, respectively. The insertion grooves 16, 17 are formed in the thickness t of the partition plate 12 and the end partition plate 13 and in the width of the insertion portions 14, 15.

As shown in FIGS. 3 and 4, the engaging portion 8*a* of the tank plate 8 of the header tank 4 includes a plurality of pressing members 19 (six (6) pressing members in this embodiment) extended into the same plane with the engaging portion 8*a* and arranged at regular intervals. As illustrated in FIG. 4, the engaging portion 7*a* of the end plate 7 is engaged with the engaging portion 8*a* of the tank plate 8 and the pressing members 19 of the tank plate 8 are bent by means of a press, so that the end plate 7 and the tank plate 8 are assembled with the end plate 7 being pressed against the tank plate 8, and brazed together.

Of the plurality of pressing members 19, the upper and lower pressing members 19 are, as shown in FIG. 3, located at the upper and lower ends of the header tank where the respective end partition plates 13 are provided. The width T of the pressing member 19 is dimensioned, for example, to 5 mm, and, consequently, the end partition plate 13 is in the width T of the pressing member.

For assembly of such header tank 4, one insertion portion 14 of each partition plate 12 and each end partition plate 13 is inserted into the corresponding insertion groove 16 of the end plate 7, and the other insertion portion 15 of each of each partition plate 12 and end partition plate 13 into the corresponding insertion groove 17 of the tank plate 8, and the engaging portion 7*a* of the end plate 7 is engaged with the engaging portion 8*a* of the tank plate 8. Then, as shown by a dots-and-chain line in FIG. 4, the tank plate 8 is pressed against the end plate 7, and each pressing member 19 is bent, thereby to assemble the header tank 4 with the partition plates 12 and the end partition plates 13 mounted thereon. Thereafter, the ends of the stacked flat tubes 2 are inserted into the insertion openings 5 of each header tank 4 to assemble the heat exchanger 1 which is blazed in a furnace for integral assembly.

During the assembly stage, the end partition plates 13 respectively placed at the upper and lower ends of the header tank 4 are each being externally pressed by the pressing member 19 which is wider than the width t of the end partition plate 13. This prevents radially opening of the tank plate 8 and the end plate 7 caused by deformation of the header tank 4 under heating during blazing in the furnace. Consequently, a gap is not formed between the end plate 7 and the tank plate 8 of the header tank 4, which establishes reliable assembly of the partition plates 12 and the end partition plates 13, which, in turn, assures reliable brazing.

Since the end openings of the header tank can be reliably closed with the end partition plates which are the same configuration with the partition plates, the use of conventional blank caps is no longer required. As a result, the length of the header tank can be made shorter, and, particularly, quantities of heat exchange medium and lubricating oil collected at the lower portion of the header tank can be reduced, thereby to reduce quantities of heat exchange medium and oil for use.

Further, by elimination of the use of conventional blank caps, the use of common parts is possible which results in reduction of the number of parts, which, in turn, reduce the number of processing steps and associated controlling works. Thus, the manufacturing cost is lowered.

Moreover, since the end partition plates 13 is externally pressed by the pressing member which is wider than the thickness of the end partition plate, a gap is not formed between the end plate and the tank plate of the header tank which establishes reliable brazing, and the yield is increased by the improved blazing.

A second embodiment of this invention will be described. The portions and members which are common with the first embodiment are designated by the same reference numerals.

Figure 7:
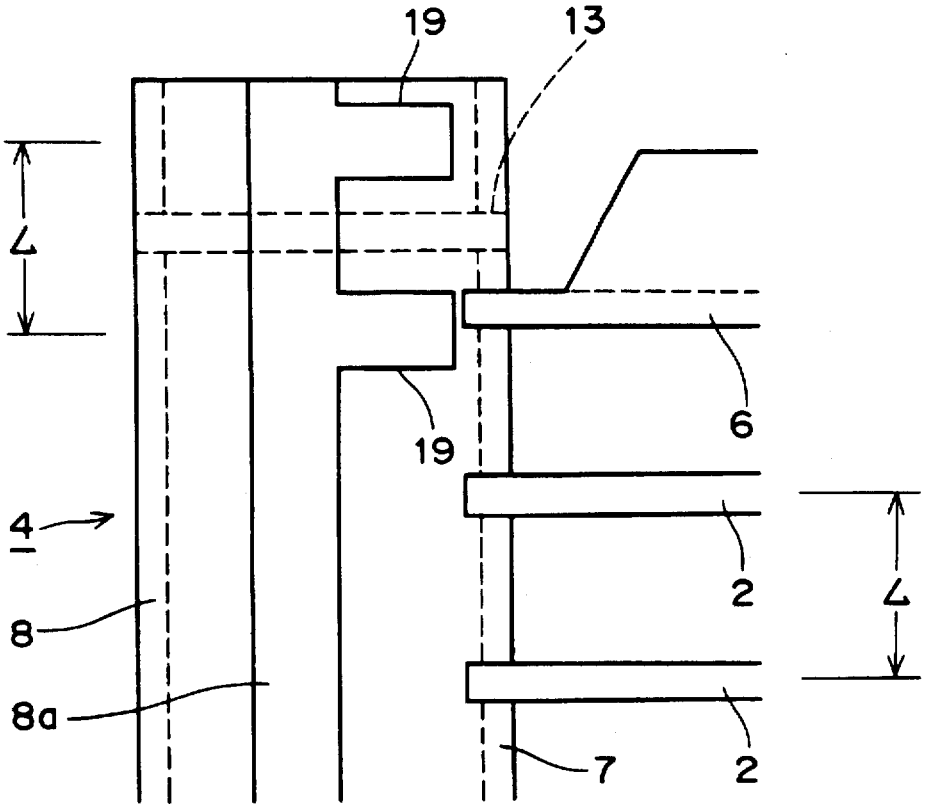
FIG. 7 is a front view of the header tank of a second embodiment of the invention.

With the heat exchanger of this second embodiment, the pressing members 19 are so provided to the tank plate 8 that, as shown in FIG. 7, they are respectively located at both sides of the end partition plate 13 provided on the header tank 4.

In this case, the positions of the pressing members 19 at both sides of the end partition plate 13 are within a range of pitch of the flat tubes 2 (namely, a length L between the adjacent flat tubes 2).

Consequently, each end partition plate is externally pressed by the pressing members located at both sides thereof and assembled in this state. Accordingly, the second embodiment can also provide the same effect as that of the first embodiment.

A third embodiment of this invention will be described below.

In addition to the first and second embodiments, this third embodiment has a structure wherein the forward end of the side plate is adapted to press the end partition plate inwardly.

Figure 8:
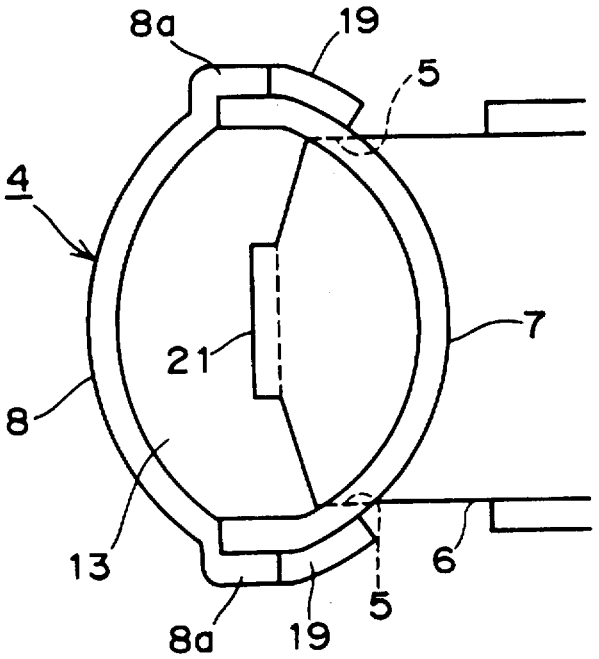
FIG. 8 is a plan view of the essential portion of a side plate of a third embodiment of the invention.
Figure 9:
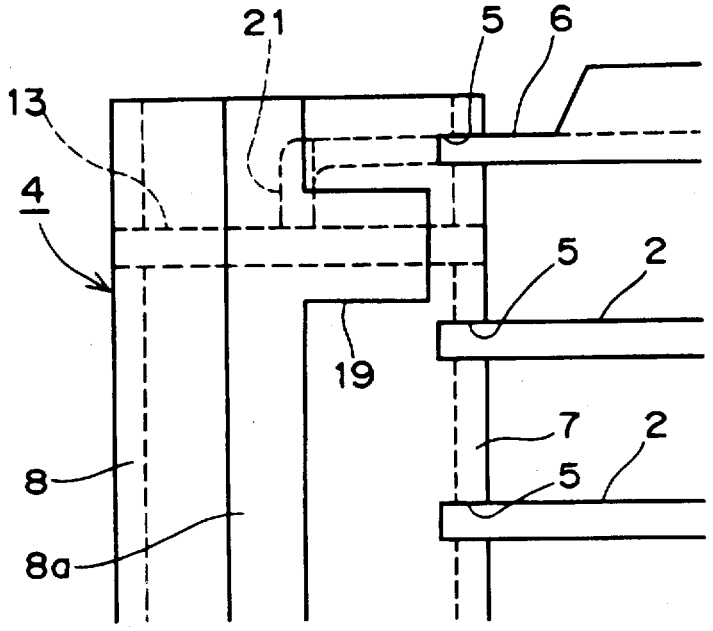
FIG. 9 is a front view of the header tank and showing the side plate.

As shown in FIGS. 8 and 9, the insertion opening 5 for the side plate 6 is provided at the end of the header tank 4, rather than for the end partition plate 13. The forward end of the side plate 6, which has been inserted into the insertion opening 5, is bent at 21 and this bent portion 21 presses the center of the end partition plate 13 inwardly of the header tank 4.

Consequently, this structure prevents displacement of the end partition plate 13 in the axial direction of the header tank during assembly of the end partition plate 13.

The side plate is not always necessary to be formed for insertion into an exclusive insertion opening. For example, a notch may be formed at the end of the end plate 7 so that the side plate is engaged with the notch and the forward end of the side plate is bent. Further, a recess may be formed at the center of the end partition plate, and the forward end of the bent portion 21 is brought into pressure contact with the recess, thereby to enhance the strength for supporting the end partition plate.

The foregoing respective embodiments have been described by forming the pressing members on the tank plate, as an example. However, this invention is not limited to this arrangement. It is also possible to provide the pressing members on the end plate. In other words, the object of the invention can be achieved by forming the pressing members on either the tank plate or the end plate integrally therewith.

Further, the aforementioned respective embodiments have been described for the case where the tank plate of the header tank is outside, but it is also possible to arrange the end plate on the outside and the tank plate inside. The tank plate and the end plate of the header tank are preferably in semi-circular or semi-oval in view of pressure resistance.

In the above-described embodiments, the pressing members are provided at locations corresponding to the positions where the end partition plates are arranged. However, a plurality of pressing members may also be provided at locations other than those corresponding to the end partition plates or both ends of the header tank.

The end partition plates and the partition plates are preferably in the same configuration for the purpose of using common parts.

In the case of a heat exchanger in large size, it is preferable that the end partition plates are thicker than the partition plates in view of pressure resistance.

In the described embodiments, the side plates are located inside the end partition plates, but the side plates may be arranged outside.

What is claimed is:

1. A heat exchanger comprising:

a plurality of tubes, corrugated fins stacked alternately with said tubes, a pair of parallel header tanks to which both ends of the tubes are connected, each header tank comprising:

partition plates provided in said each header tank, an end plate, a tank plate cooperating with said end plate to form a tank assembly, wherein first pressing members are provided on one of the end plate and the tank plate for pressing one of the plates against the other plate for engagement therewith; said each header tank characterized in that end partition plates are provided near ends of the header tank, the first pressing members on one of the plates are located only at first positions corresponding to positions where the end partition plates are provided, and that said first pressing members on said one of the plates are bent to be continuous contact with an external surface of said the other plate to exert pressures on said external surface against side faces of said end partition plates.

2. The heat exchanger according to claim 1, which further comprises second pressing members provided on one of the plates at second positions corresponding to positions of the partition plates.

3. The heat exchanger according to claim 2, wherein the end partition plates have a thickness greater than that of the partition plates.

4. The heat exchanger according to claim 1, wherein the end partition plates are thicker than the partition plates.

* * * * *